US006016414A

United States Patent [19]

Anayama et al.

[11] Patent Number: 6,016,414

[45] **Date of Patent: *Jan. 18, 2000**

[54] ELECTROPHOTOGRAPHIC PHOTOSENSITIVE MEMBER, ELECTROPHOTOGRAPHIC APPARATUS AND PROCESS CARTRIDGE

[75] Inventors: Hideki Anayama, Yokohama; Akio Maruyama, Tokyo; Kazushige Nakamura, Yokohama, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/567,535

[22] Filed: Dec. 5, 1995

[30] Foreign Application Priority Data

Dec. 7, 1994 [JP] Japan ..... 6-303946

[51] Int. Cl.[7] ..... G03G 15/00

[52] U.S. Cl. ..... 399/159; 430/56; 430/61; 430/66

[58] Field of Search ..... 355/211, 212; 430/56, 61, 66, 69, 83, 84, 95, 96; 399/159

[56] References Cited

U.S. PATENT DOCUMENTS

| | | | |
|---|---|---|---|
| 2,297,691 | 10/1942 | Carlson | 95/5 |
| 4,985,326 | 1/1991 | Sakamoto | 430/96 |
| 5,232,804 | 8/1993 | Molaire | 430/83 |
| 5,242,774 | 9/1993 | Odell et al. | 430/59 |
| 5,352,552 | 10/1994 | Maruyama et al. | 430/66 X |
| 5,352,554 | 10/1994 | Mishima et al. | 430/59 |
| 5,391,449 | 2/1995 | Maruyama et al. | 430/66 |
| 5,422,210 | 6/1995 | Maruyama et al. | 430/59 |
| 5,789,126 | 8/1998 | Sugimura | 430/96 X |

FOREIGN PATENT DOCUMENTS

| | | |
|---|---|---|
| 0446895 | 9/1991 | European Pat. Off. . |
| 0606074 | 7/1994 | European Pat. Off. . |
| 53-103741 | 9/1978 | Japan . |
| 56-42863 | 4/1981 | Japan . |
| 5-100464 | 4/1993 | Japan . |

*Primary Examiner*—Matthew S. Smith
*Attorney, Agent, or Firm*—Fitzpatrick, Cella, Harper & Scinto

[57] ABSTRACT

An electrophotographic photosensitive member comprising a conductive support, a photosensitive layer and a protective layer containing a setting resin, characterized in that the photosensitive layer contains a resin which has a glass transition point of 170° C. or more. The above image forming apparatus has excellent durability and good image forming properties.

10 Claims, 1 Drawing Sheet

ELECTROPHOTOGRAPHIC PHOTOSENSITIVE MEMBER, ELECTROPHOTOGRAPHIC APPARATUS AND PROCESS CARTRIDGE

BACKGROUND OF THE INVENTION

1. Field of the Invention

The present invention relates to an electrophotographic photosensitive member, and more particularly to an electrophotographic photosensitive member comprised of a protective layer containing particular resin and a photosensitive layer containing a particular compound. The present invention also relates to an electrophotographic apparatus and process cartridge.

2. Description of the Prior Art

An electrophotographic photosensitive method, as described in the specification of U.S. Pat. No 2,297,691, uses a photoconductive material which is an insulator in the dark, but has a changeable electrical resistance according to quantity of light. The main characteristics which the electrophotographic member requires are as follows.

(1) To be charged to a suitable voltage in the dark.

(2) To maintain the suitable voltage in the dark.

(3) To lose charge promptly when irradiated with light.

In particular, since a surface of a photosensitive member is liable to damage by external electrical and mechanical forces caused by a charger, an image exposure means, a development means and a cleaning means, the photosensitive member is required to withstand those external forces. In other words, an electrophotographic photosensitive member (hereinbelow referred to as "a photosensitive member") is required to have durability against electrical deterioration caused by ozone or nitrogen oxide which are generated during the step of corna charging, and against mechanical deterioration caused by contact with other components. Especially, it is desired to improve the durability of a photosensitive member based on an organic photoconductive substance.

To improve the durability of a photosensitive member, it has been tried to provide, on the photosensitive layer a protective layer, containing resin as a main ingredient. For instance, Japanese Laid-Open Patent Application No 56-42863 and No 53-103741 disclose that a protective layer containing setting type resin improves the durability of the photosensitive member. However, when such setting type resin is used as a protective layer which contains resin as a main ingredient, the protective layer or the photosensitive layer may crack, because the protective layer shrinks. For the purpose of solving this problem, it is proposed in Japanese Laid Open Patent Application No 5-100464 to use an acrylic type monomer as the setting type resin.

SUMMARY OF THE INVENTION

An object of the present invention is to provide a photosensitive member which can maintain high image quality without accumulating a residual potential and photo-memory during repeated use of the photosensitive member.

Another object of the present invention is to provide an electrophotographic apparatus and a process cartridge using the aforesaid electrophotographic photosensitive member.

The present invention provides a photosensitive member comprising a conductive support, a photosensitive layer and a protective layer containing a setting resin, characterised in that the photosensitive layer contains a resin which has a glass transition point of 170° C. or more.

The invention also provides an electrophotographic apparatus and a process cartridge using a photosensitive member comprising a conductive support, a photosensitive layer and a protective layer containing a setting resin, characterised in that the photosensitive layer contains a resin which has a glass transition point of 170° C. or more.

Embodiments of the above photosensitive member can exhibit a low residual potential and a low photo-memory during repeated use. The electrophotographic apparatus and the process cartridge of the invention exhibit excellent image forming properties.

BRIEF DESCRIPTION OF THE DRAWINGS

How the invention may be put into effect will not be described, by way of example only, with reference to the accompanying drawings in which.

DETAILED DESCRIPTION OF THE INVENTION

Figure 1:
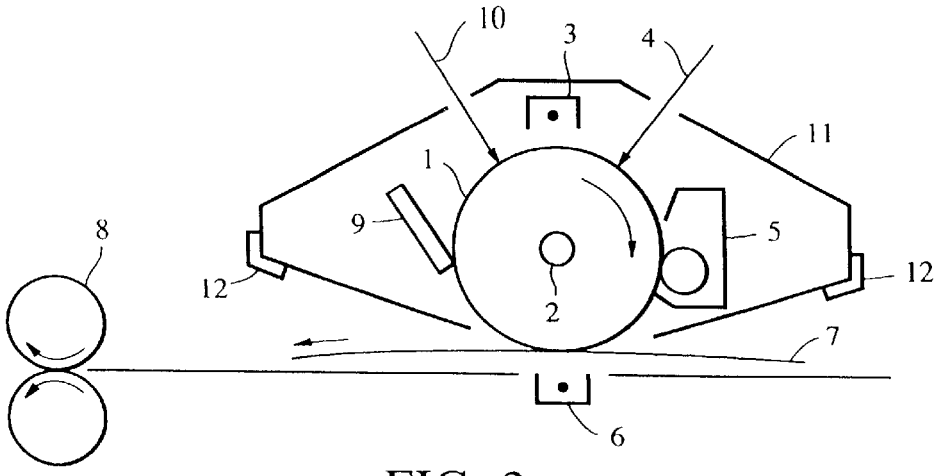
FIG. 1 is a diagrammatic side view of one embodiment of an electrophotographic apparatus according to the invention.

In the following description "part(s)" and "%" means "weight part(s)" and "weight %" respectively.

The photosensitive member of the present invention comprises a conductive support, a photosensitive layer and a protective layer in this order. The protective layer contains setting resin. The photosensitive layer contains a resin which has a glass transition point of 170° C. or more. The setting resin used in the protective layer is made from the liquid containing monomer or oligomer. If necessary, the liquid contains a polymerisation initiator. The liquid is hardened by heat or light to form the setting resin, that is to say, at first the liquid is coated onto the photosensitive layer. Then the coated liquid is hardened to form the protective layer.

Examples of the setting resin preferably include acrylic resin, urethane resin, silicone resin and melamine resin. Among the aforesaid resins, acrylic resins are particularly preferred because they are excellent in respect to coating properties, hardening properties and stability of the coating liquid.

Preferable examples of acrylic monomers are set out below, but the acrylic monomers usable in the present invention are not limited to these examples.

| COMPOUND NO | STRUCTURAL FORMULA | NUMBER OF FUNCTIONAL GROUPS |
|---|---|---|
| (1) | $CH_3CH_2-C(CH_2OR)_3$ | 3 |
| (2) | $CH_3CH_2-C-(CH_2CH(CH_3)OR')_3$ | 3 |
| (3) | $CH_2CH-C(CH_2OR')-(CH_2CH(CH_3)OR')_2$ | 3 |
| (4) | $CH_2CH-C(CH_2CHOR)(CH_3)-(CH_2OR)_2$ | 3 |
| (5) | $HOCH_2-C(CH_2OR')_3$ | 3 |
| (6) | $HOCH_2-C(CH_2OR)_2-CH_2OCH_2-C(CH_2OR)_2-CH_2OH$ | 4 |
| (7) | $ROCH_2-C(CH_2OR)_2-CH_2OCH_2-C(CH_2OR)_2-CH_2OR$ | 6 |
| (8) | $(R'OCH_2)_3C-CH_2OCH_2-C(CH_2OR')-(R'OC_5H_{10}-C(=O)-O)_2$ | 6 |
| (9) | 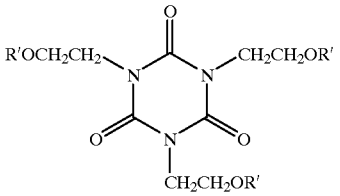 | 3 |
| (10) | $CH_3CH_2C-(CH_2OC_3H_6OR)_3$ | 3 |

-continued
| COMPOUND NO | STRUCTURAL FORMULA | NUMBER OF FUNCTIONAL GROUPS |
|---|---|---|
| (11) | 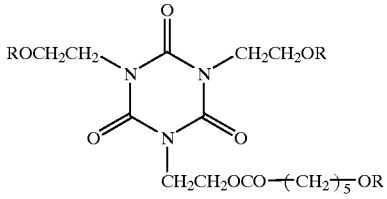 | 3 |
| (12) | $(ROCH_2)_3C—O—C(CH_2OR)_3$ | 6 |
| (13) | $(ROCH_2)_3C—CH_2OCH_2—C(H)(CH_2OR)_2$ | 5 |
| (14) | $(ROCH_2)_3C—CH_2OCH_2—C(CH_3)(CH_2OR)_2$ | 5 |
| (15) | $(ROCH_2)_3C—CH_2OCH_2—C(CH_2OH)(CH_2OR)_2$ | 5 |
| (16) | $(R'OCH_2)_3C—CH_2OCH_2—C(CH_2OR')(CH_2OH)_2$ | 4 |
| (17) | $(ROCH_2)_3C—O—C(CH_2OH)(CH_2OR)_2$ | 5 |
| (18) | 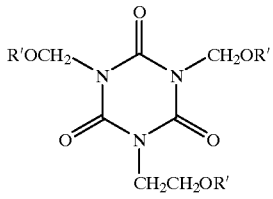 | 3 |
| (19) | $CH_3CH_2(CH_2CH_2OR)_3$ | 3 |
| (20) | $HOCH_2—C\left(CH_2O—C(=O)CH_2CH_2CH_2CH_2CH_2OR\right)_3$ | 3 |
| (21) | 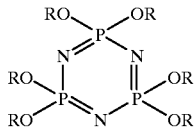 | 6 |
| (22) | 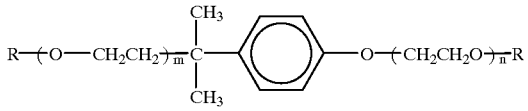 | 2 |
| (23) | 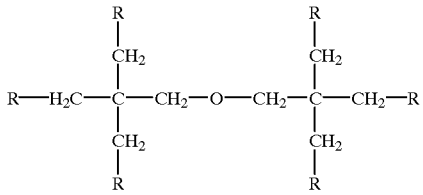 | 6 |

In the above formulae, R and R' are given by the following formulae:

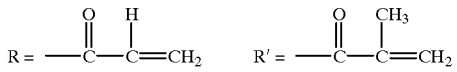

The resin used in the present invention may be obtained from two or more setting type resins or may be mixed with other types of resins such as polyester, polycarbonate, polyurethane, silicone resin, alkyd resin, and copolymers of vinyl chloride and vinyl acetate.

If necessary, a polymerisation initiator can be used with the setting resin. The amount of addition of the polymerisation initiator is preferably in a range of 0.1 to 80% based on the total weight of the monomer and olgomer, more preferably in a range of 0.5 to 50%. The photopolymerisation initiator is preferable to the thermal polymerisation initiator, because volume shrinkage during photopolymerisation is smaller than that of thermal polymerisation. Examples of the photo initiators used are enumerated below, but not in a limiting sense.

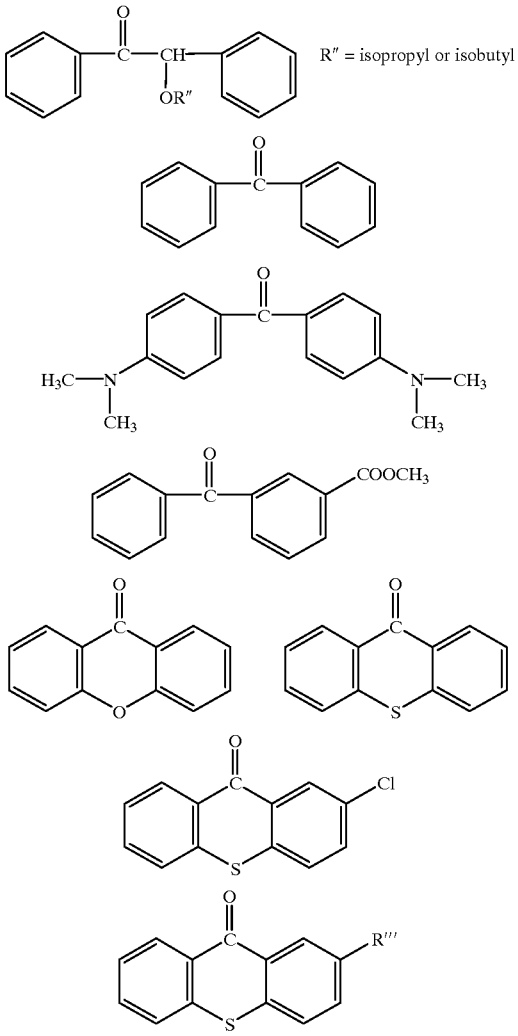

-continued

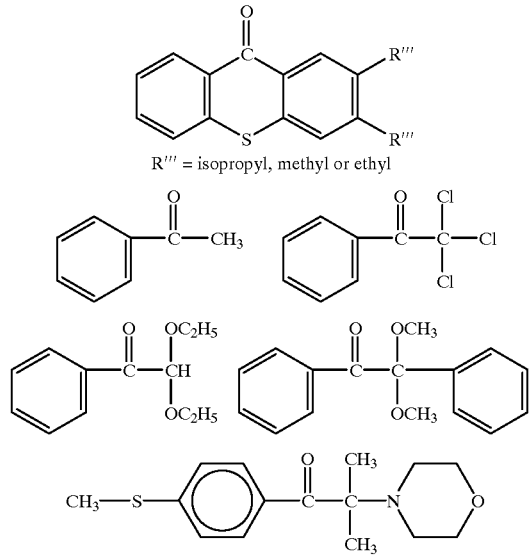

From the standpoint of adjusting resistance of the protective layer, the protective layer of the present invention may contain conductive particles such as particles of metal oxide in a dispersed state.

Examples of such particles of conductive metal oxide are particles of zinc oxide, titanium oxide, tin oxide, antimony oxide, indium oxide, bismuth oxide, zirconium oxide, indium oxide doped with tin and tin oxide doped with antimony. These metal oxides may be used singly or in combination of two or more kinds. The content of particles of metal oxide is preferably in a range of 5 to 90% of the protective layer, more preferably in a range of 10 to 90%. If the content of metal oxide is less than 5 wt %, the electrical resistance of the protective layer might be too high. If it is greater than 90%, the electrical resistance is liable to be lower than a level required for the outermost layer of the photosensitive member, thus resulting in a poor charging ability and pin holes in the outermost layer.

In the present invention, in order to improve lubricity or stability, lubricious compound such as polytetrafluoroethylene may be also dispersed in the protective layer.

Furthermore, in order to improve dispersibility, adhesion and stability, various coupling agents or anti-oxidizing agents may be contained in the protective layer.

The thickness of the protective layer in the present invention is preferably in a range of 0.1 to 10 $\mu$m, more preferably in a range of 0.5 to 7 $\mu$m.

The protective layer can be applied by any of known methods such as spray coating method and dipping coat method. From the standpoint of productivity the dipping coat method is preferable.

The protective layer is formed on the photosensitive layer. The photosensitive layer preferably comprises a charge generation layer and a charge transport layer. The protective layer is preferably formed on the charge transport layer which comprises a charge transport substance and a binder.

In order to get a high quality image, it is needed to decrease the residual potential. As the result of a study of the residual potential and the photo-memory, the inventors have found a relation between the residual potential and the photo-memory of the photosensitive member, and the resin of the photosensitive layer. By using a resin which has a glass transition temperature (herein below referred to as "Tg") of 170° C. or more as a binder the residual potential can be decreased, and charge does not accumulate during the repeated use of the photosensitive member.

Although the invention is not limited by any theory of its operation, the mechanism of the present invention may be as follows. If the setting resin is used in the protective layer, the monomer or oligomer of the setting resin act as organic solvents and attack the photosensitive layer. The photosensitive layer near its boundary with the protective layer becomes swollen. As a result, the charge transporting substance or polymerisation initiator could migrate to form an electrical trap. The electrical trap prevents the decrease of the residual potential.

On the other hand, by using a high Tg resin as a binder for the photosensitive layer, the swelling of the photosensitive layer can be prevented, so that the charge transporting substance and the polymerisation initiator do not migrate. As a result, an electrical trap is not formed, and the residual potential can decrease. In other words, by using a resin which has high degree of crystallinity, the photosensitive layer has steric hindrance which prevents the charge transporting substance and polymerisation initiator from migrating.

The photosensitive layer preferably contains a resin which has Tg of 240° C. or below. If the photosensitive layer contains a resin which has too high a Tg, it is liable to crack. In the present invention, Tg is measured by using the DTA curve of the resin. The weight average molecular weight of the resin which has a Tg of 170° C. or more is probably 5000–1000000, more preferably 15000–100000. The resin which has Tg of 170° C. or more may be used singly or in combination of a resin which has Tg under 170° C. The content of the resin which has Tg of 170° C. or more is preferably 50% or more of the binder of the photosensitive layer.

Example of the resin which has Tg of 170° C. or more may include polycarbonate which has excellent anti-solvent character and hardness. The polycarbonate in the present invention contains carbonic ester bonds in the main chain, and is preferably prepared by polymerizing bisphenol compounds by a phosgene method or an ester interchange method.

Examples of the charge transporting substance may include triarylamine type compounds, hydrazone type compounds, stilbene type compounds, pyrazoline type compounds, oxazole type compounds, triarylmethane type compounds and thiazole type compounds.

The thickness of the charge transport layer is preferably 4–30 μm, more preferably 5–20 μm. The weight ratio of the charge transporting substance to the resin is preferably 1/10–20/10, more preferably 5/10–10/10.

The charge generation layer and the charge transport layer may be disposed on a support in this order or in reverse order. The charge generation layer may be formed on the support by applying a coating liquid which comprises a charge generating substance and a binder, or by vapour-deposition of the charge generating substance on a support. Examples of the charge generating substance may include phthalocynaine pigments, azo pigments and anth-anthrone pigments. Examples of the binder for use in the charge generation layer may include polyester, polyacryl, polyvinylcarbazole, phenoxy resin, polycarbonate, polystyrene, polyvinylacetate, polysulfone, polyarylate, vinylidene chloride-acrylonitrile copolymer and polyvinylbenzal. The weight ratio of the binder to the charge-generating substance is preferably 1/5–5/1, more preferably 1/2–3/1.

The photosensitive layer may be constituted by a single layer. In case of the single layer, the photosensitive layer is provided on the support by applying a coating liquid which comprising the charge generating substance, the charge transporting substance and the resin which has Tg or 170° C. or more.

In addition, an intermediate layer may be provided between the support and the photosensitive layer. The intermediate layer functions as a barrier layer for charges and as a bonding layer. Examples of the material forming the layer preferably include polyamide, polyurethane, polyether urethane, polyvinyl alcohol, polyethylene oxide, ethyl cellulose and casein. The thickness of the intermediate layer is preferably in a range of 0.1–5 μm, more preferably in a range of 0.1–1 μm.

Furthermore, a conductive layer may be provided under the intermediate layer. The conductive layer is effective for preventing interference fringes and covering defects of the support. The conductive layer is formed on the support by applying a coating liquid which comprises particles of a conductive material and a binder. The thickness of the conductive layer is preferably 5–40 μm, more preferably 5–30 μm.

The coating method of the aforesaid layers may include for instance dip coating, spray coating, beam coating, bar coating, blade coating and roller coating.

The support for use in the photosensitive member of the present invention may be prepared by using various materials including: metal or metal alloy, such as aluminum, aluminum alloy, copper, titanium, or stainless steel; a polymeric material such as polyethylene terephthalate, phenolic resin, polypropylene, or polystyrene; and hard or rigid paper. The support may preferably be in the form of a cylinder or drum, a belt, or a sheet. When the materials for the support have a high volume resistivity, the support is required to be subjected to conductive treatment. The conductive treatment can be performed by forming a conductive layer on the support or by dispersing a conductive substance within the support.

The photosensitive member of the present invention is applicable to not only electrophotographic copying machines, but also a wide field of electrophotographic applications such as a laser beam printer, a cathode-ray tube (CRT) printer, a light-emitting diode (LED) printer, a liquid crystal printer, a facsimile machine and other fields of applied electrophotography, e.g. laser plate making.

Hereinbelow, an electrophotographic apparatus according to the present invention will be explained.

FIG. 1 shows a schematic structural view of an embodiment of an electrophotographic apparatus using a process cartridge. The process cartridge has an electrophotographic photosensitive member of the present invention in it. Referring to FIG. 1, a photosensitive drum (i.e. photosensitive member) 1 is rotated about an axis 2 at a prescribed peripheral speed in the direction of the arrow shown inside the photosensitive drum 1. The surface of the photosensitive drum is uniformly charged by means of a first charger 3 to have a prescribed positive or negative potential. The photosensitive drum 1 is subjected to image exposure with light 4 (e.g. slit exposure or laser beam-scanning exposure) using an image exposure means (not shown), so that an electrostatic latent image corresponding to an exposure image is successively formed on the peripheral surface of the photosensitive drum 1.

The electrostatic latent image is developed with toner by a developing means 5 to form a toner image. The toner image is successively transferred to a recording material 7 which is supplied from a supply station (not shown) to a position between the photosensitive drum 1 and a transfer charger 6 in synchronism with the rotating speed of the photosensitive drum 1.

The recording material 7 with the toner image thereon is separated from the photosensitive drum 1 and is conveyed to a fixing station 8, followed by image fixing to print out the recording material 7 as a copy outside the electrophotographic apparatus.

Residual toner particles on the surface of the photosensitive drum 1 after the transfer are removed by means of a cleaner 9 to provide a cleaned surface, and residual charge on the surface of the photosensitive drum 1 is erased by a pre-exposure means (not shown) to prepare for the next cycle. If a contact charger which touches the photosensitive drum 1 is used instead of a corona charger, the pre-exposure means is not always needed. According to the present invention, in the electrophotographic apparatus, it is possible to provide a process cartridge 11 which includes plural means inclusive of or selected from the photosensitive member 1 (photosensitive drum), the first charger 3, the developing means 5, the cleaner 9, etc so as to be attached or removed as desired. The process cartridge 11 may, for example, be composed of the photosensitive member 1 and at least one out of the first charger 3 developing means 5 and the cleaner 9, and be capable of being attached to or removed from the body of the electrophotographic apparatus by using a guiding means such as a rail 12 in the body.

In case where the electrophotographic apparatus is used as a copying machine or a printer, image-wise exposure with light-image 4 may be effected by using reflection light or transmitted light from an original or by reading data on the original by a sensor, converting the data into a signal and then effecting laser beam scanning, driving of an LED array or driving of a liquid crystal shutter array in accordance with the signal.

Figure 2:
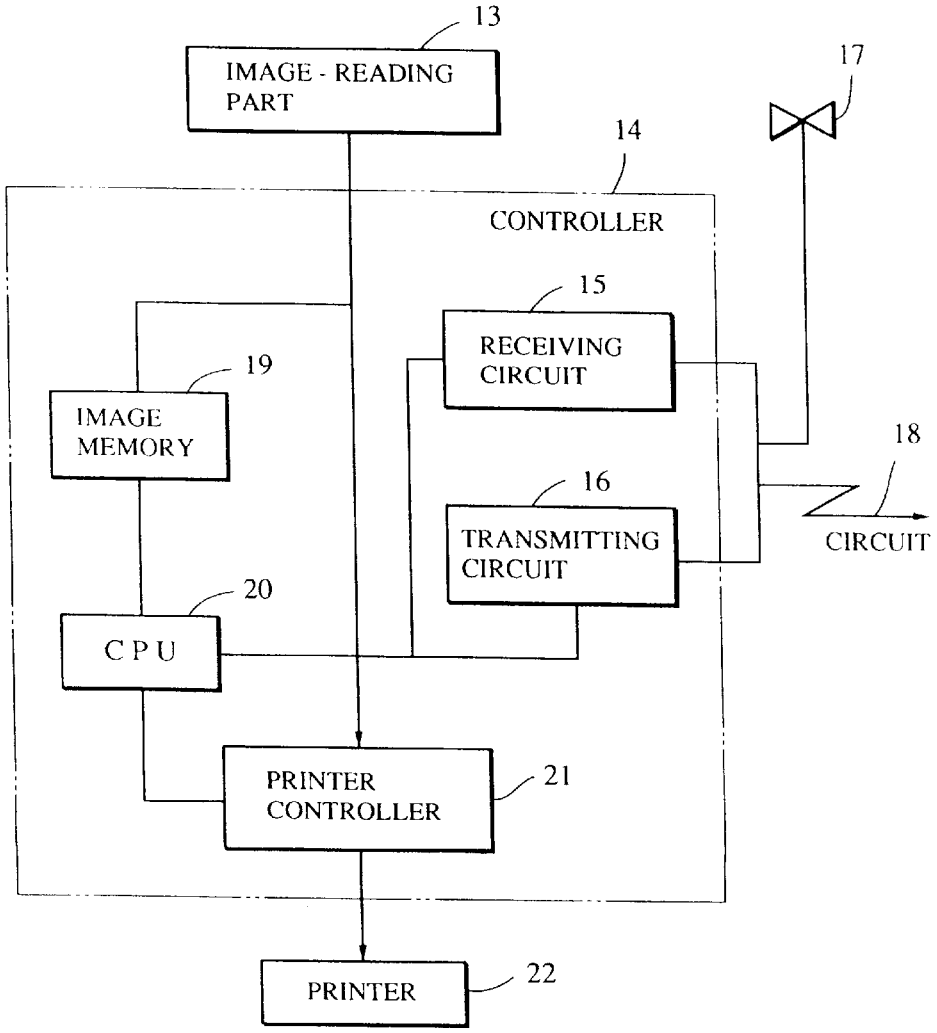
FIG. 2 is a block diagram of a facsimile machine using the electrophotographic photosensitive member according to the invention.

In the case where the electrophotographic apparatus is used as a printer for a facsimile machine, the image-wise exposure with light 4 may be performed to print the received data. FIG. 2 shows an example of this case in the form of a block diagram.

A controller 14 controls a image-reading part 13 and a printer 22. The controller 11 is controlled in its entirety by a CPU 17. The read data from the image-reading part 13 is transmitted to a partner station via transmitting circuit 16. The data received from the partner station is sent to the printer 22 via a receiving circuit 15. An image memory 19 stores predetermined image data therein. A printer controller 21 controls the printer 22. Denoted at 17 is a telephone set.

The image information received from a line 18 (i.e. the image information received from a remote terminal connected via the line) is demodulated by the receiving circuit 15, decoded by the CPU 20, and then stored in the image memory 19 successively. When the image information of at least one page is stored in the image memory 19, image recording of that page is stored in the image memory 19, image recording of that page takes place. The CPU 20 reads the image information of one page out of the image memory 19 and sends the decoded image information of one page to the printer controller 21. Upon receiving the image information of one page from the CPU 20, the printer controller 21 controls the printer 22 to perform the image information recording of that page. Note that during the recording by the printer 22, the CPU 20 is receiving the image information of next page. The receiving and recording of images are carried out in this manner.

Hereinbelow, the present invention will be explained in more specifically with reference to examples.

EXAMPLE 1

The following coating liquid was applied onto an aluminum cylinder (outer diameter of 30 mm, length of 260 mm) by dipping, followed by drying for 30 minutes at 140° C. to form a conducting layer having a thickness of 15 μm.

| Coating Liquids | |
|---|---|
| Conductive pigments: | |
| titanium oxide particles having a coating layer of tin oxide | 10 parts |
| Pigment: | |
| titanium oxide | 10 parts |
| Binder: | |
| phenol resin | 10 parts |
| Levelling agent: | |
| silicone oil | 0.001 parts |
| Solvent: | |
| methanol/methyl cellosolve = 1/1 | 20 parts |

Then, 3 parts of an N-methoxymethylated nylon and 3 parts of copymeric nylon were dissolved in a mixture of 65 parts of methanol and 30 parts of butanol to prepare a coating liquid. The coating liquid was applied onto he above-prepared conductive layer by dipping, followed by drying to form a intermediate layer having a thickness of 0.5 μm.

Next, a mixture of 4 parts of an oxytitaniumphthalocyanine pigment, 2 parts of a polyvinyl butyral resin (Trade name S-LEC BM-2 mfd. by Sekusui Kagaku Kogyo KK) and 80 parts of cyclohexanone was dispersed for 4 hours by a sand mill using glass heads (diameter 1 mm). After that, 115 parts of a methyl ethyl ketone was added to the mixture to provide a coating liquid for a charge-generation layer. The resultant coating liquid was applied onto the above-prepared intermediate layer by dipping, followed by drying to form a charge-generation layer having a thickness of 0.3 μm. In the X-ray diffraction pattern based on CuKα characteristic X-ray, the oxytitaniumphthalocyanine pigment has main peaks of Bragg angle (2θ±0.2°) at 9.0°, 14.2°, 23.9° and 27.1°.

Subsequently 10 parts of a triarylamine compound represented by the following formula:

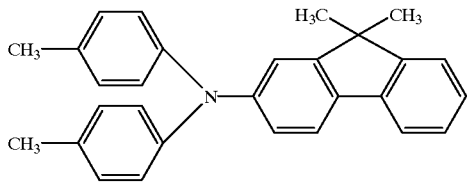

and 10 parts of polycarbonate No 1 shown in Table 1 were dissolved in a mixture of 30 parts of monochlorobenzene and 30 parts of dichloromethane to prepare a coating liquid. The coating liquid was applied onto the above prepared charge generation layer by dipping and dried for 1 hour at 110° C. to form a charge transport layer having a thickness of 20 μm.

Next a suspension for the protective layer was prepared in the following manner. A mixture of 30 parts of 3,3,3-trifluoropropyl trimethoxy silane (SHINETSU KAGAKU KK), 100 parts of particles of tin oxide containing antimony (trade name: T-1, manufactured by MITSUBISHI MATERIAL KK) and 300 parts of an aqueous solution (95% ethanol-5% water) was dispersed for an hour in a milling apparatus, followed by filtering. After filtering, the particles of tin oxide were cleaned with ethanol, and heated at 120° C. for an hour to treat the surface of the particles.

Subsequently, 25 parts of the aforesaid acrylic monomer compound No 23 as a binder, 0.5 parts of 2-methylthioxanthrone as a photopolymerisation initiator, 35 parts of the treated particles of tin oxide and 300 parts of toluene were mixed for 96 hours in a sand mill. Then, 25 parts of tetrafluoroethylene particles (trade name: LUBRON L-2, DAIKIN KOGYO KK) was added into the sand mill, and mixed for 8 hours to prepare the suspension for the protective layer.

The resultant mixture was applied onto the charge transport layer by spray coating, followed by drying and exposing for 15 seconds by a high pressure mercury-vapour lamp of power 800 mW/cm$^2$ to form a protective layer having a thickness of 4 $\mu$m.

TABLE 1
| No | POLYMER STRUCTURE | | | Mw | Tg (° C.) |
|---|---|---|---|---|---|
| 1 | 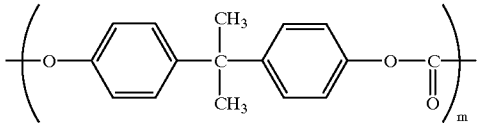 | 50 wt % | 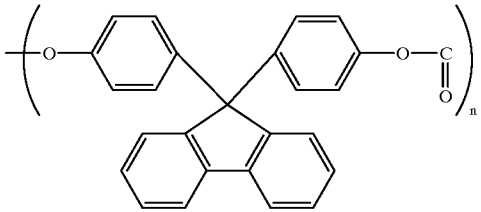 | 50 wt % 20000 | 225 |
| 2 | 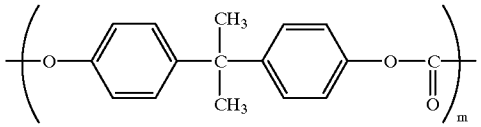 | 67 wt % | 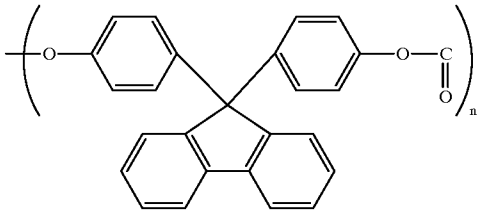 | 33 wt % 21000 | 199 |
| 3 | 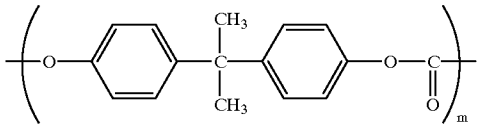 | 80 wt % | 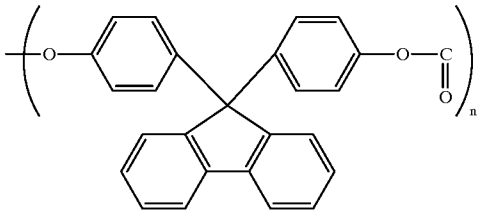 | 20 wt % 21000 | 176 |
| 4 | 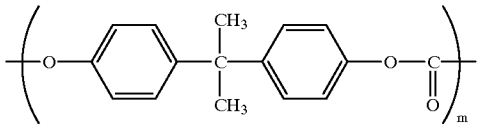 | 85 wt % | 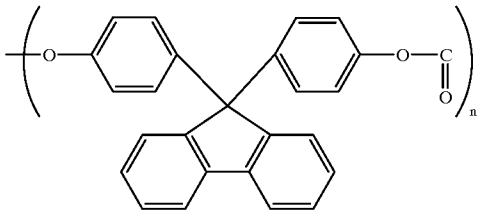 | 15 wt % 20000 | 163 |

TABLE 1-continued
| No | POLYMER STRUCTURE | | | | Mw | Tg (° C.) |
|---|---|---|---|---|---|---|
| 5 | 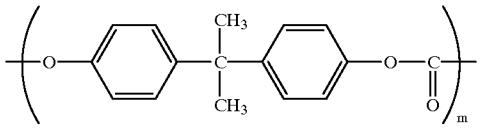 | 85 wt % | 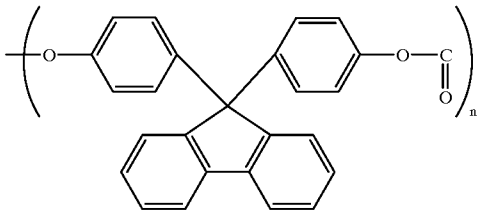 | 15 wt % | 80000 | 174 |
| 6 | 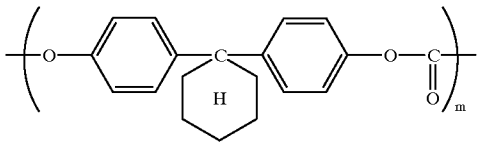 | 80 wt % | 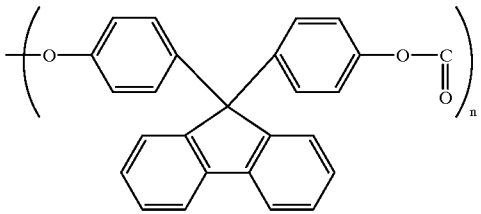 | 20 wt % | 20000 | 187 |
| 7 | 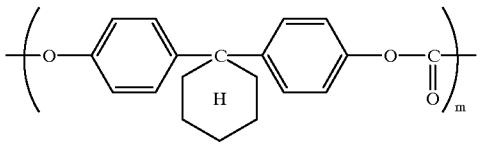 | 90 wt % | 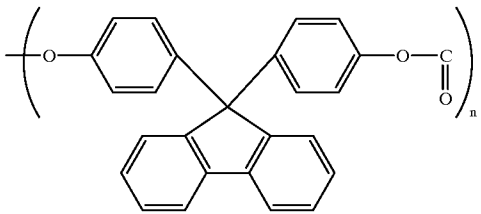 | 10 wt % | 20000 | 160 |
| 8 | — | — | 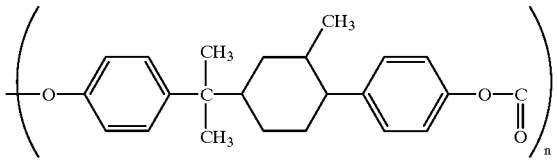 | 100 wt % | 20000 | 202 |

TABLE 1-continued
| No | POLYMER STRUCTURE | | | | Mw | Tg (° C.) |
|---|---|---|---|---|---|---|
| 9 | 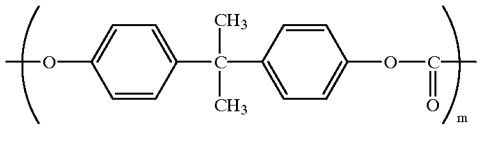 | 50 wt % | 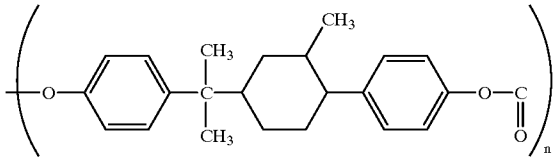 | 50 wt % | 22000 | 178 |
| 10 | 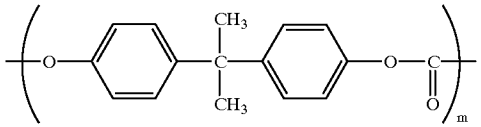 | 80 wt % | 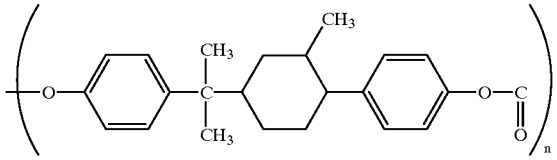 | 20 wt % | 23000 | 163 |
| 11 | 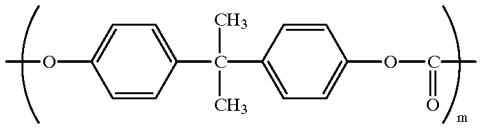 | 60 wt % | 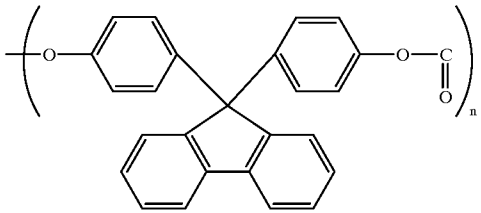 | 10 wt % | 19500 | 185 |
| | | | 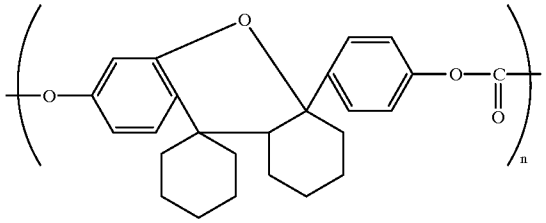 | 30 wt % | | |

TABLE 1-continued
| No | POLYMER STRUCTURE | | | | Mw | Tg (° C.) |
|---|---|---|---|---|---|---|
| 12 | 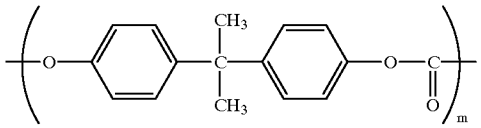 | 60 wt % | 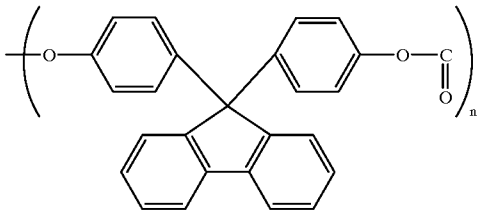 | 10 wt % | 32000 | 179 |
| | | | 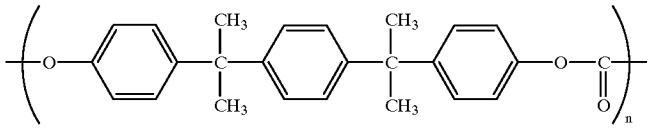 | 30 wt % | | |
| 13 | 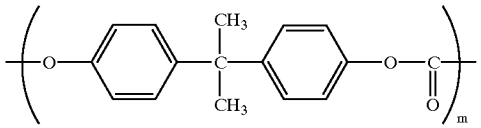 | 100 wt % | — | — | 24000 | 137 |
| 14 | 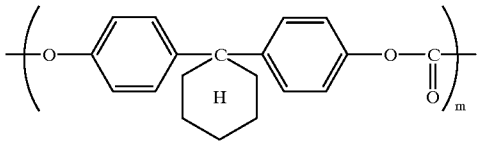 | 100 wt % | — | | 29000 | 158 |
| 15 | 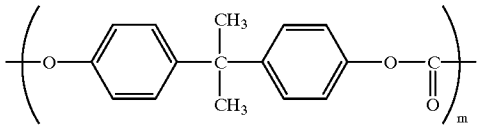 | 50 wt % | 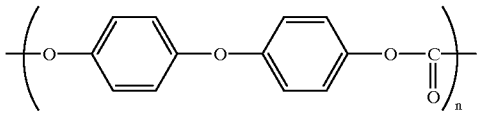 | 50 wt % | 22000 | 130 |

EXAMPLES 2–9

Photosensitive members of the present invention were prepared in the same manner as in Example 1 except that the polycarbonate No 1 used in Example 1 was changed to polycarbonate No 2 (Example 2), No 3 (Example 3), No 5 (Example 4), No 6 (Example 5), No 8 (Example 6), No 9 (Example 7), No 11 (Example 8) and No 12 (Example 9) show in Table 1. Each of the photosensitive members (Example 1–9) were evaluated in the following manner.

First of all, each photosensitive member was left under the conditions of 23° C. and 30% RH all night, then the photosensitive member was assembled in a laser beam printer (trade name: LBP-NX, manufactured by Canon Inc) to measure a residual potential.

The aforesaid laser beam printer was improved, that is to say, the developing means and a cleaner were removed from a process cartridge. A potential sensor was installed in the position where the developing means had been. The transfer roller was removed.

The residual potential was measured in the following manner. First, the photosensitive member was rotated through several revolutions which is equivalent to printing on 5 sheets. During the rotation, the photosensitive member was exposed by light, e.e. a black image mode. Then the potential (Vl) of the surface of the photosensitive member was measured. Furthermore, the photosensitive member was rotated 5 revolutions with the laser on, but the first charger off. After that, the surface potential of the photosensitive member was measured again. In the present invention, the latter potential was defined as "a residual potential". After the Vl and residual potential were measured, i.e. after the initial measurement, a durability test was carried out by making 15,000 copies successively. Then the Vl and residual potential were measured again.

On the other hand, the photo-memory was measured in the following manner. New photosensitive members of examples 1–9 were provided. First, each of the photosensitive members was partially exposed by a fluorescent light of 2000 lux for 6 minutes and left for 2 minutes in a dark place, then Vl of the exposed part and Vl of the unexposed part of the photosensitive member were measured. In the present invention, the difference value between the Vl of exposed part and the Vl of unexposed part was defined as "a photo-memory".

Next an image formed by using each photosensitive member was evaluated visually. The pattern of the image was black stripes of 1 dot width. The results are shown in Table 2.

TABLE 2

| | INITIAL | | AFTER DURABILITY | | | |
|---|---|---|---|---|---|---|
| EXAMPLE | V 1 (−V) | RESIDUAL POTENTIAL (−v) | V 1 (−V) | RESIDUAL POTENTIAL (−v) | PHOTO-MEMORY (−V) | IMAGE QUALITY |
| 1 | 140 | 45 | 150 | 50 | 45 | GOOD |
| 2 | 145 | 47 | 155 | 55 | 47 | " |
| 3 | 155 | 55 | 160 | 65 | 50 | " |
| 4 | 156 | 55 | 167 | 70 | 50 | " |
| 5 | 140 | 45 | 145 | 55 | 45 | " |
| 6 | 150 | 50 | 165 | 65 | 45 | " |
| 7 | 150 | 55 | 170 | 75 | 55 | " |
| 8 | 145 | 40 | 158 | 50 | 50 | " |
| 9 | 150 | 45 | 170 | 60 | 55 | " |

COMPARATIVE EXAMPLES 1–6

Photosensitive members were prepared in the same manner as in Example 1 except that the polycarbonate No 1 used in Example 1 was changed to a polycarbonate No 4 (Comp Example 1), No 7 (Comp Example 2), No 10 (Comp Example 3), No 13 (Comp Example 4), No 14 (Comp Example 5) and No 15 (Comp Example 6) shown in Table 1. Each photosensitive member was evaluated in the same way as Example 1. The results are shown in Table 3.

TABLE 3

| | INITIAL | | AFTER DURABILITY | | | |
|---|---|---|---|---|---|---|
| COMP EXAMPLE | V 1 (−V) | RESIDUAL POTENTIAL (−v) | V 1 (−V) | RESIDUAL POTENTIAL (−v) | PHOTO-MEMORY (−V) | IMAGE QUALITY |
| 1 | 170 | 65 | 220 | 110 | 75 | BLACK LINES AND LOW DENSITY |

TABLE 3-continued

| COMP EXAMPLE | INITIAL V 1 (−V) | INITIAL RESIDUAL POTENTIAL (−v) | AFTER DURABILITY V 1 (−V) | AFTER DURABILITY RESIDUAL POTENTIAL (−v) | PHOTO-MEMORY (−V) | IMAGE QUALITY |
|---|---|---|---|---|---|---|
| 2 | 185 | 75 | 230 | 130 | 80 | BLACK LINES AND LOW DENSITY |
| 3 | 210 | 75 | 255 | 115 | 70 | BLACK LINES AND LOW DENSITY |
| 4 | 2()() | 75 | 235 | 1.15 | 105 | BLACK LINES AND LOW DENSITY |
| 5 | 230 | 70 | 255 | 105 | 90 | BLACK LINES AND LOW DENSITY |
| 6 | 250 | 100 | 320 | 175 | 100 | BLACK LINES AND LOW DENSITY |

EXAMPLES 10–18

Photosensitive members were prepared in the same manner as Example 1–9 except that each acrylic monomer compound No 23 used as a binder in Examples 1–9 was changed to the aforesaid acrylic monomer compound No 22.

Each photosensitive member was evaluated in the same way as Example 1. The results are shown in Table 4.

TABLE 4

| EXAMPLE | INITIAL V 1 (−V) | INITIAL RESIDUAL POTENTIAL (−v) | AFTER DURABILITY V 1 (−V) | AFTER DURABILITY RESIDUAL POTENTIAL (−v) | PHOTO-MEMORY (−V) | IMAGE QUALITY |
|---|---|---|---|---|---|---|
| 10 | 155 | 55 | 160 | 55 | 50 | GOOD |
| 11 | 155 | 55 | 160 | 60 | 45 | " |
| 12 | 170 | 60 | 175 | 70 | 60 | " |
| 13 | 165 | 65 | 179 | 80 | 65 | " |
| 14 | 155 | 50 | 155 | 65 | 50 | " |
| 15 | 160 | 60 | 168 | 75 | 50 | " |
| 16 | 160 | 65 | 170 | 85 | 65 | " |
| 17 | 150 | 45 | 160 | 60 | 65 | " |
| 18 | 165 | 55 | 170 | 70 | 60 | " |

EXAMPLES 19 AND 20

Photosensitive members were prepared in the same manner as Examples 1 and 2 except that each charge transporting substance was changed to following charge transporting substance. Each photosensitive member was evaluated in the same way as Example 1. The results are shown in Table 5.

TABLE 5

| EXAMPLE | INITIAL V 1 (−V) | INITIAL RESIDUAL POTENTIAL (−v) | AFTER DURABILITY V 1 (−V) | AFTER DURABILITY RESIDUAL POTENTIAL (−v) | PHOTO-MEMORY (−V) | IMAGE QUALITY |
|---|---|---|---|---|---|---|
| 19 | 150 | 50 | 150 | 50 | 50 | GOOD |
| 20 | 155 | 55 | 160 | 50 | 45 | " |

COMPARATIVE EXAMPLES 7 AND 8

Photosensitive members were prepared in the same manner as Comparative Examples 1 and 2 except that each charge transporting substance was changed to following charge transporting substance. Each photosensitive member was evaluated in the same way as Example 1. The result are shown in Table 6.

TABLE 6

| | INITIAL | | AFTER DURABILITY | | | |
|---|---|---|---|---|---|---|
| COMP EXAMPLE | V 1 (−V) | RESIDUAL POTENTIAL (−v) | V 1 (−V) | RESIDUAL POTENTIAL (−v) | PHOTO-MEMORY (−V) | IMAGE QUALITY |
| 7 | 190 | 70 | 220 | 105 | 90 | BLACK LINES |
| 8 | 190 | 85 | 230 | 115 | 100 | BLACK LINES |

EXAMPLES 21–23

Photosensitive members were prepared in the same manner as in Example 2 except that that polycarbonate No 2 used in Example 2 was changed to following mixtures polycarbonates No 2 and No 13 shown in Table 1.

| | Polycarbonate No 2 | Polycarbonate No 13 |
|---|---|---|
| Example 21 | 70 parts | 30 parts |
| Example 22 | 60 parts | 40 parts |
| Example 23 | 50 parts | 50 parts |

Each photosensitive member was evaluated in the same way as Example 1. The results are shown in Table 7.

TABLE 7

| | INITIAL | | AFTER DURABILITY | | | |
|---|---|---|---|---|---|---|
| EXAMPLE | V 1 (−V) | RESIDUAL POTENTIAL (−v) | V 1 (−V) | RESIDUAL POTENTIAL (−v) | PHOTO-MEMORY (−V) | IMAGE QUALITY |
| 21 | 145 | 50 | 155 | 60 | 47 | GOOD |
| 22 | 145 | 50 | 155 | 60 | 45 | " |
| 23 | 150 | 60 | 165 | 70 | 55 | " |

COMPARATIVE EXAMPLES 9 AND 10

Photosensitive members were prepared in the same manner as in Example 1 and Comparative Example 1 except that the thickness of the charge transport layer was changed to 24 μm and the protective layer was not used. Each photosensitive member was evaluated in the same way as Example 1. The results are shown in Table 8.

TABLE 8

| | INITIAL | | AFTER DURABILITY | | | |
|---|---|---|---|---|---|---|
| COMP EXAMPLE | V 1 (−V) | RESIDUAL POTENTIAL (−v) | V 1 (−V) | RESIDUAL POTENTIAL (−v) | PHOTO-MEMORY (−V) | IMAGE QUALITY |
| 9 | 130 | 35 | — | — | 115 | ABRASION OF THE PHOTO-SENSITIVE LAYER AFTER 3,000 SHEETS |

TABLE 8-continued

| COMP EXAMPLE | INITIAL V 1 (−V) | INITIAL RESIDUAL POTENTIAL (−v) | AFTER DURABILITY V 1 (−V) | AFTER DURABILITY RESIDUAL POTENTIAL (−v) | PHOTO-MEMORY (−V) | IMAGE QUALITY |
|---|---|---|---|---|---|---|
| 10 | 135 | 35 | — | — | 115 | NOT CLEAR IMAGE AFTER 5,000 SHEETS |

We claim:

1. An electrophotographic photosensitive member having enhanced durability and providing high image quality without accumulating significant residual potential during repeated use comprising: a conductive support, a photosensitive layer containing a polycarbonate resin and a protective layer containing a setting resin, wherein said setting resin of said protective layer is selected from the group consisting of acrylic resin, urethane resin, silicone resin and melamine resin, and wherein said polycarbonate resin of said photosensitive layer is at least one resin and which (i) provides a glass transition point of 170° C. or more and (ii) has 9,9-fluorenilidene or 2,2-propylidene as a central unit.

2. The member of claim 1, wherein the glass transition point of said resin of said photosensitive layer is 170° C. to 240° C.

3. The member of claim 1 or 2, wherein said resin of said photosensitive layer is polycarbonate.

4. The member of claim 1, wherein the content of said resin of said photosensitive layer is 50 weight % or more of a total amount of a binder of the layer in which said resin of said photosensitive layer is contained.

5. The member of claim 1, wherein the setting resin is hardened by light.

6. The member of claim 1, wherein the protective layer contains a photopolymerisation initiator.

7. The member of claim 1, wherein the setting resin is acrylic resin.

8. The member of claim 1, wherein the photosensitive layer comprises a charge generation layer and a charge transport layer on the charge generation layer.

9. An electrophotographic apparatus using an electrophotographic photosensitive member having enhanced durability and providing high image quality without accumulating significant residual potential during repeated use comprising: a conductive support, a photosensitive layer containing a polycarbonate resin, and a protective layer containing a setting resin, wherein said setting resin of said protective layer is selected from the group consisting of acrylic resin, urethane resin, silicone resin and melamine resin, and wherein said polycarbonate resin of said photosensitive layer is at least one resin and which (i) provides a glass transition point of 170° or more and (ii) has 9,9-fluorenilidene or 2,2-propylidene as a central unit.

10. A process cartridge using an electrophotographic photosensitive member having enhanced durability and providing high image quality without accumulating significant residual potential during repeated use comprising: a conductive support, a photosensitive layer containing a polycarbonate resin, and a protective layer containing a setting resin, wherein said setting resin of said protective layer is selected from the group consisting of acrylic resin, urethane resin, silicon resin and melamine resin, and wherein said polycarbonate resin of said photosensitive layer is at least one resin and which (i) provides a glass transition point of 170° C. or more and (ii) has at least one group of 9,9-fluorenilidene or 2,2-propylidene as a central unit.

* * * * *

UNITED STATES PATENT AND TRADEMARK OFFICE

CERTIFICATE OF CORRECTION

PATENT NO. : 6,016,414
DATED : January 18, 2000
INVENTOR(S) : Hideki Anayama et al.

It is certified that error appears in the above-identified patent and that said Letters Patent is hereby corrected as shown below:

Column 1,
Line 38, "corna" should read -- corona --.

Column 7,
Line 19, "olgomer" should read -- oligomer --.

Column 9,
Line 35, "Example" should read -- An example --; and
Line 59, "phthalocynaine" should read -- phthalo -cyanine --.

Column 10,
Line 4, "comprising" should read -- comprises --.

Column 23,
Line 8, "show" should read -- shown --;
Line 15, "improved," should read -- modified, -- and
Line 25, "e.e." should read --i.e., --.

Column 25,
Table 3, "70 255" should read -- 70 265 --.

UNITED STATES PATENT AND TRADEMARK OFFICE

CERTIFICATE OF CORRECTION

PATENT NO. : 6,016,414
DATED : January 18, 2000
INVENTOR(S) : Hideki Anayama et al.

It is certified that error appears in the above-identified patent and that said Letters Patent is hereby corrected as shown below:

Column 27,
Line 6, "result" should read -- results --.

Column 29,
Line 38, "photopolymerisation" should read -- photo- polymerization --.

Column 30,
Line 36, "silicon" should read -- silicone --.

Signed and Sealed this

Seventh Day of August, 2001

Nicholas P. Godici

*Attest:*

*Attesting Officer*

NICHOLAS P. GODICI
*Acting Director of the United States Patent and Trademark Office*